US005979513A

United States Patent [19]

Brand

[11] Patent Number: 5,979,513

[45] Date of Patent: Nov. 9, 1999

[54] FUEL SPILLAGE CONTROL APPARATUS HAVING AUDIBLE WARNING

[76] Inventor: Randolf W. Brand, P.O. Box 80828, Fairbanks, Ak. 99708

[21] Appl. No.: 08/647,582

[22] Filed: May 13, 1996

Related U.S. Application Data

[63] Continuation of application No. 08/647,582, May 13, 1996, which is a continuation-in-part of application No. 08/228,663, Apr. 18, 1994, Pat. No. 5,515,889, which is a continuation-in-part of application No. 08/047,918, Apr. 19, 1993, Pat. No. 5,323,820, which is a continuation-in-part of application No. 08/010,080, Jan. 28, 1993, Pat. No. 5,225,721, which is a continuation-in-part of application No. 07/638,322, Jan. 7, 1991, Pat. No. 5,186,222.

[51] Int. Cl.[6] ..... B65B 1/04

[52] U.S. Cl. ..... 141/86; 141/311 A; 141/59

[58] Field of Search ..... 141/59, 86, 95, 141/94, 97, 198, 206–229, 285, 286, 290, 291, 292, 295, 301, 302, 305, 311 R, 311 A, 346–348, 392; 220/86.1, 86.2, 86.3, 89.1; 116/109–112, 227, DIG. 7; 137/587, 558

[56] References Cited

U.S. PATENT DOCUMENTS

| | | | |
|---|---|---|---|
| 1,352,792 | 4/1920 | Day . | |
| 1,992,151 | 2/1935 | Woodbridge . | |
| 2,212,620 | 8/1940 | Scully et al. | 116/110 |
| 2,276,798 | 3/1942 | Scully et al. | 137/558 |
| 2,935,099 | 5/1960 | Haynes | 141/95 |
| 3,739,937 | 6/1973 | Stock . | |
| 3,927,702 | 12/1975 | Ingle . | |
| 4,278,115 | 7/1981 | Briles . | |
| 4,410,100 | 10/1983 | Simmons . | |
| 4,441,533 | 4/1984 | Snyder et al. . | |
| 4,593,714 | 6/1986 | Madden . | |
| 4,615,362 | 10/1986 | Hartman . | |
| 4,637,522 | 1/1987 | Klop . | |
| 4,706,718 | 11/1987 | Milo . | |
| 4,762,440 | 8/1988 | Argandona . | |
| 4,763,806 | 8/1988 | Pogers . | |
| 4,854,469 | 8/1989 | Hargest . | |
| 4,971,225 | 11/1990 | Biavo . | |
| 4,988,020 | 1/1991 | Webb . | |
| 5,016,689 | 5/1991 | McGarvey et al. . | |
| 5,023,608 | 6/1991 | Delisle, Jr. et al. | 116/112 |
| 5,088,530 | 2/1992 | Harp . | |
| 5,186,222 | 2/1993 | Brand . | |
| 5,230,372 | 7/1993 | Westphal | 141/86 |
| 5,255,721 | 10/1993 | Brand . | |
| 5,322,099 | 6/1994 | Langlois | 141/86 |
| 5,323,820 | 6/1994 | Brand . | |
| 5,501,255 | 3/1996 | Tortu et al. | 141/95 |
| 5,515,889 | 5/1996 | Brand . | |

OTHER PUBLICATIONS

705 Flex Catch brochure; E.R.W. of Muskegon, Michigan; date unknown.

The Container brochure; Wigdahl, Gore S. Associates; date unknown.

*Primary Examiner*—Steven O. Douglas

*Attorney, Agent, or Firm*—Lyon & Lyon LLP

[57] ABSTRACT

A fluid spillage control apparatus is connected to a fluid tank which has a fill opening and a ventilation opening. The fluid spillage control apparatus comprises a fluid holding chamber having a vent opening for venting vapor therefrom. The fluid holding chamber also has a conduit communicating with a fluid tank ventilation opening for passage of excess fluid from the fluid tank into the fluid holding chamber. The conduit is aparallel with the longitudinal axis of the fluid holding chamber so that the fluid holding chamber can be oriented in both a first position wherein the fluid holding chamber longitudinal axis is oriented vertically and a second position wherein the fluid holding chamber longitudinal axis is oriented horizontally. In addition, an auditory signal device communicates with the vent opening and produces an auditory signal upon passage of vented vapor from the fluid holding chamber.

15 Claims, 3 Drawing Sheets

FUEL SPILLAGE CONTROL APPARATUS HAVING AUDIBLE WARNING

This application is a Continuation application, Ser. No. 08/647,582 filed May 13, 1996 which is a continuation-in-part of U.S. patent application Ser. No. 08/228,663, now U.S. Pat. No. 5,515,889 filed Apr. 18, 1994, which is a continuation-in-part of Ser. No. 08/047,918 filed Apr. 19, 1993, now U.S. Pat. No. 5,323,820, which is a continuation-in-part of Ser. No. 08/010,080, filed Jan. 28, 1993, now U.S. Pat. No. 5,225,721, which is a continuation-in-part of Ser. No. 07/638,322, filed Jan. 7, 1991, now U.S. Pat. No. 5,186,222.

BACKGROUND OF THE INVENTION

The present invention generally pertains to fuel spillage control devices. Specifically, this invention pertains to an apparatus for retaining fuel within an enclosed chamber, the fuel emanating from the ventilation opening of a fuel tank.

Fuel storage units commonly employed for commercial, marine and residential energy and heating needs include a fuel tank, a fill conduit, and a ventilation opening. To replenish the fuel in these fuel storage units, the nozzle of the filling device (a mobile fuel tanker truck or the like) is inserted into the fill conduit communicating with the fuel tank.

As the fuel tank of the fuel storage unit is filled, air is vented out of the fuel tank's vent opening. When the fuel tank is full and an automatic shut-off switch is present on the nozzle, the fuel will stop flowing out of the nozzle when the fuel fills the fuel fill conduit. However, prior to this automatic shut-off, fuel will flow out of the fuel receptacle's vent opening, thus polluting the environment.

If the nozzle of the filling device does not have an automatic shut-off switch, the fuel attendant shuts off fuel flow manually, often upon observation of the fuel flowing out of the fuel receptacle's vent opening and into the environment.

Fuel receptacles adapted to be attached to the ventilation openings of fuel tanks are generally known.

However, these devices suffer from venting of fuel into the environment through their own vent openings, contamination of the fuel in the fuel tank due to dirt and water entering their vent openings, the inability to automatically return fuel in the device to the fuel tank for use, and the inability to separate contaminates from the fuel in the device prior to returning it to the fuel tank.

SUMMARY OF THE INVENTION

A fluid spillage control apparatus is connected to a fluid tank which has a fill opening and a ventilation opening. The fluid spillage control apparatus comprises a fluid holding chamber having a vent opening for venting vapor therefrom. The fluid holding chamber also has a conduit communicating with a fluid tank ventilation opening for passage of excess fluid from the fluid tank into the fluid holding chamber. The conduit is aparallel with the longitudinal axis of the fluid holding chamber so that the fluid holding chamber can be oriented in both a first position wherein the fluid holding chamber longitudinal axis is oriented vertically and a second position wherein the fluid holding chamber longitudinal axis is oriented horizontally. In addition, an auditory signal device communicates with the vent opening and produces an auditory signal upon passage of vented vapor from the fluid holding chamber.

In the preferred embodiment, the sound from the auditory signal device of the fluid spillage control apparatus of the present invention is interrupted as fluid intermittently contacts the vent opening of the fuel tank; the sound terminates as fluid fills the fuel tank vent opening and enters the fuel holding chamber of the present invention. Preferably, the fluid spillage control apparatus further comprises a slit in the conduit which communicates with the fluid holding chamber so that fluid in the fluid holding chamber returns to the fluid tank. In addition, the fluid holding chamber of the fluid spillage control apparatus of the present invention preferably has a floor comprised of at least a first portion and a second portion in which the second portion is angled with respect to the first portion to direct fluid in the fluid chamber into the slit in the conduit. Preferably, the fluid spillage control apparatus of the present invention further comprises a plate oriented adjacent the end of the conduit to deflect fluid downwardly into the fluid holding chamber.

BRIEF DESCRIPTION OF THE DRAWINGS

These and other features of the present invention will be more fully appreciated when considered in light of the following specification and drawings in which.

DETAILED DESCRIPTION OF THE PREFERRED EMBODIMENT

Figure 1:
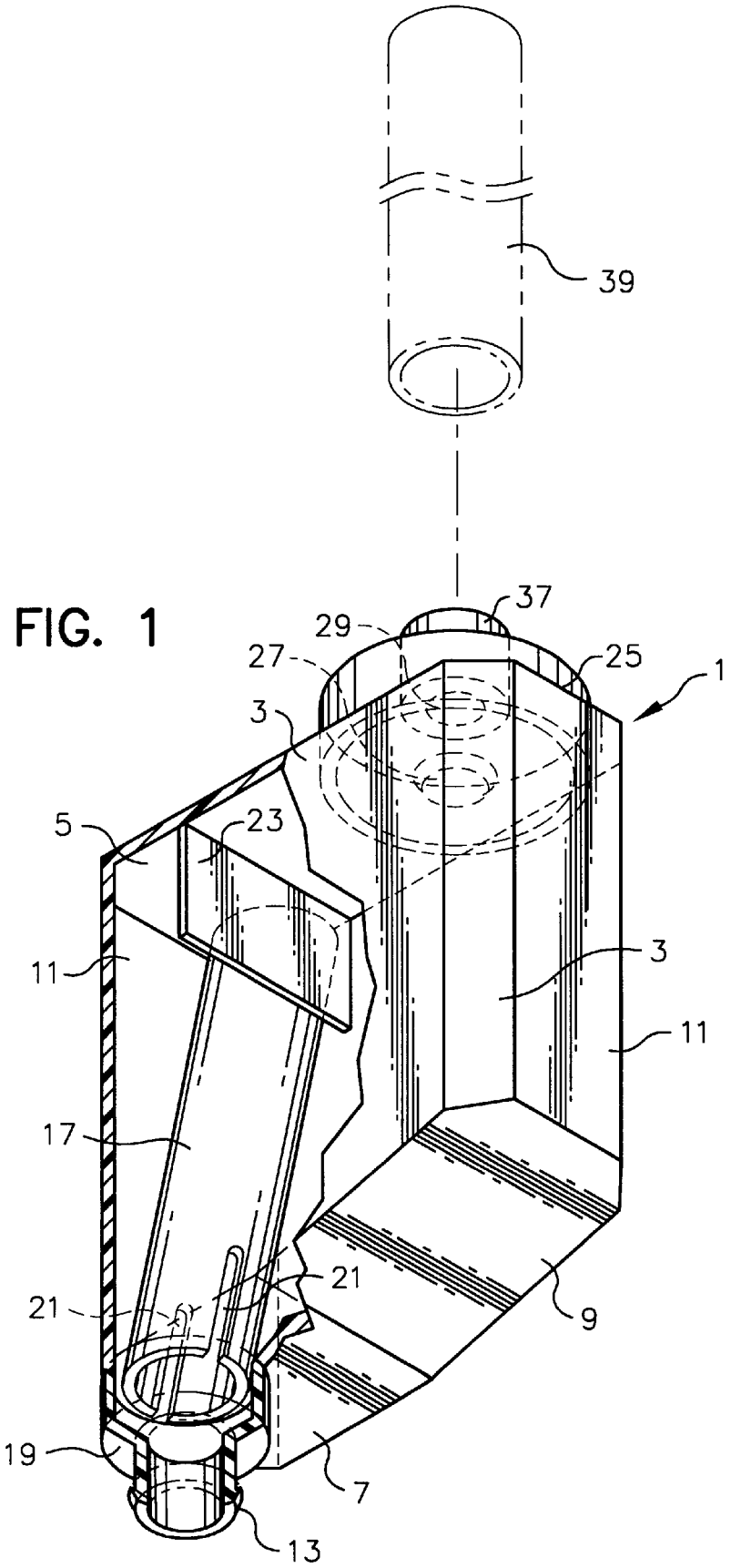
FIG. 1 is a perspective view, partially exposed and taken from in front of and below an embodiment of the present invention.

The present invention is a fuel spillage control apparatus adapted to be attached to the ventilation opening or conduit of a fuel tank that also has a fill conduit. The fuel spillage control apparatus of the present invention collects overflow fluid from the fuel tank and returns this fuel to the fluid tank while venting air and other gasses from the fuel tank into the external environment. The types of fuel tanks contemplated for use with the present invention are well known in the art and include commercial, residential and marine fuel tanks.

Referring to FIGS. 1 through 5, the fuel spillage control apparatus of the present invention includes fluid holding chamber 1 having sides 3, top 5, first bottom portion 7, second bottom portion 9, and ends 11. First bottom portion 7 is preferably parallel with horizontal, and second bottom portion 9 preferably forms an acute angle with respect to horizontal such that second bottom portion 9 is angled with respect to first bottom portion 7 to cause fluid within fluid holding chamber 1 to drain back into the fuel tank through the fuel tank ventilation opening as described in more detail below.

Collar 13, having an orifice therein, provides ingress of excess fluid into fluid holding chamber 1 from the fuel tank, exit of the excess fluid from fluid holding chamber 1 back into the fuel tank, and is journaled to fit within the ventilation opening of the fuel tank or an attachment hose attached to the ventilation opening. Conduit 17 is located within fluid holding chamber 1 and is sized to fit within circular recess 19 of first bottom portion 7 such that conduit 17 communicates with the orifice of collar 13. While conduit 17 is shown as a pipe in the present embodiment, it is to be understood that conduit 17 can be any device that allows passage of fluid from the vent opening of the fuel tank into fluid holding chamber 1. For example, conduit 17 could be formed by an internal wall, not shown, which joins with a side 3, first bottom portion 7 and an end 11 to bound the orifice of collar 13. Slits 21 in conduit 17 provide drainage of excess fluid back into the fuel tank after it has been collected within fluid holding chamber 1. Slits 21 are only exemplary of any shape of orifice that can drain fluid back into the fuel tank. As previously stated, the relative angle of said second bottom portion 9 maximizes the amount of fluid located in first bottom portion 7 to be drained through slits 21 back into the fuel tank. Note that while slits 21 are shown passing through the bottom end of conduit 17, slits 21 can be located such that a distance exists between the bottom end of conduit 17 and slits 21 in order for a predetermined amount of fuel to remain within fluid holding chamber 1 and not be drained back into the fuel tank so that sediment and contaminants that may settle in the bottom of fuel holding chamber 1 are not to be returned to the fuel tank.

Figure 2:
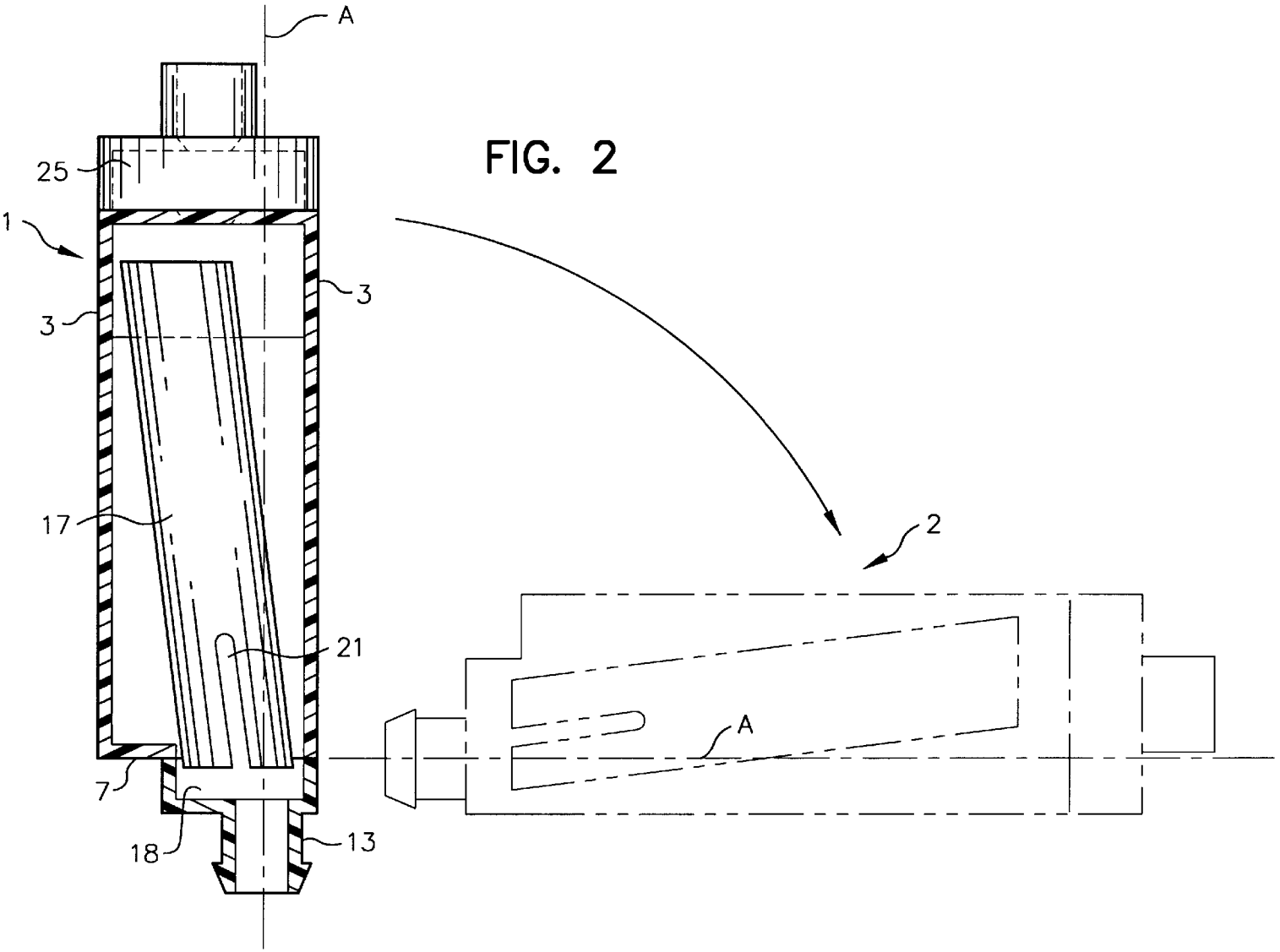
FIG. 2 is an exposed end view of an embodiment of the present invention showing the angled orientation of the conduit within the fluid holding chamber.

As shown in FIG. 2, conduit 17 is configured to be held within circular recess 18 of first bottom portion 7 at an angle relative to longitudinal axis A of fluid holding chamber 1 such that fluid holding chamber 1 is operable in both the first position shown in solid line in FIG. 2 wherein the longitudinal axis is substantially perpendicular with horizontal, and the second position as shown in dotted lines in FIG. 2 in which the longitudinal axis is substantially parallel with horizontal.

Figure 3:
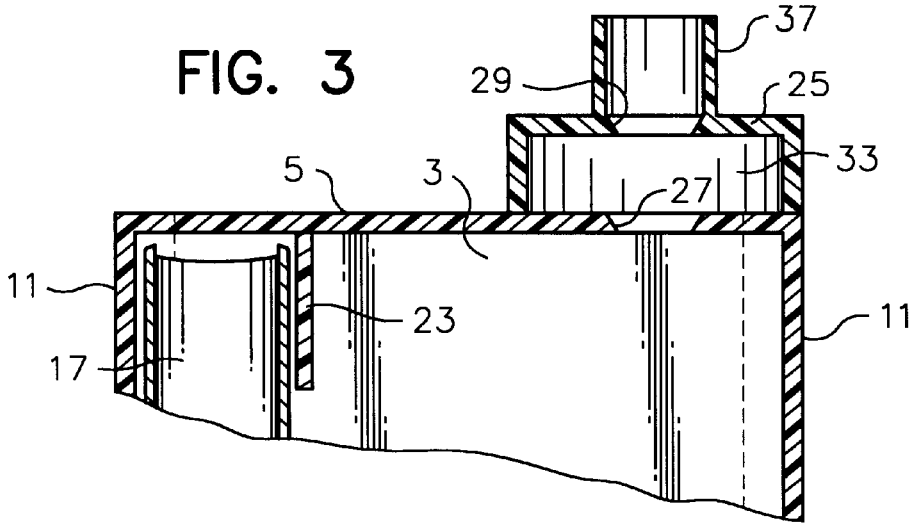
FIG. 3 is an exposed partial side view of an embodiment of the present invention showing the deflector plate and audible warning device.
Figure 4:
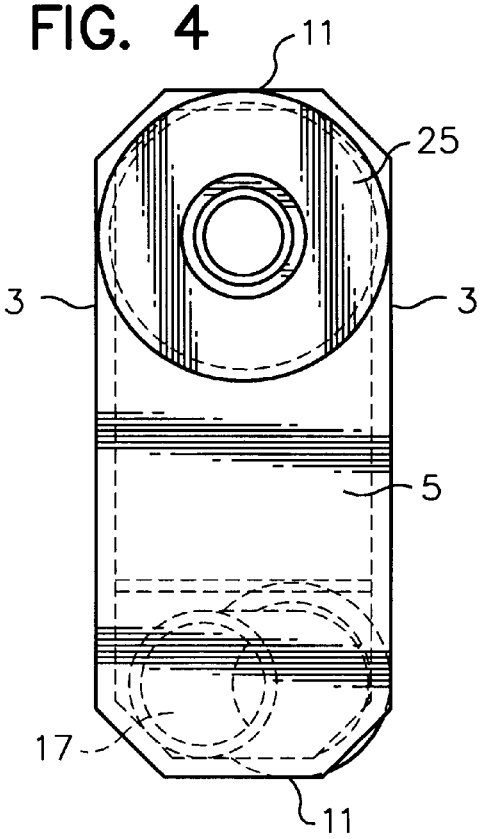
FIG. 4 is a top view of an embodiment of the present invention.
Figure 5:
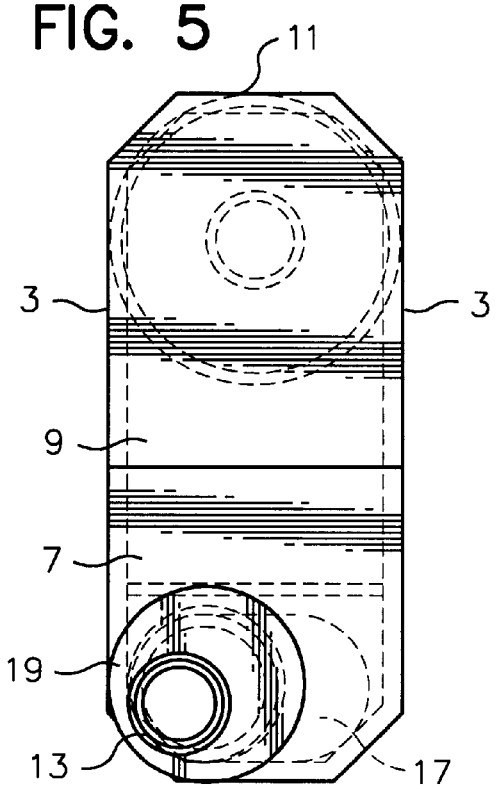
FIG. 5 is a bottom view of an embodiment of the present invention.

As shown in FIGS. 1 and 3, deflector plate 23 is provided adjacent the upper opening of conduit 17 such that excess fluid passing through conduit 17 impacts upon top 5 of fluid holding chamber 1 and deflector 23 and is then deflected downwardly to first bottom portion 7 and second bottom portion 9 of fluid holding chamber 1.

Audible warning device 25 is located on top 5 of fluid holding chamber 1, and is constructed to emit a whistle-type sound as liquid fills the fuel tank due to the displacement of air within the fuel tank which passes through fluid holding chamber 1 and through audible warning device 25. Furthermore, an important aspect of the present invention is that, as liquid intermittently contacts the vent opening of the fluid tank, i.e., just before overfilling actually occurs, the sound emanating from audible warning device 25 will become intermittent due to the sporadic interruption in air travel from the fuel tank to fluid holding chamber 1. A second warning of fluid overflow occurs when fluid actually enters conduit 17 of fluid holding chamber 1, thus terminating the passage of air from the fuel tank into fluid holding chamber 1, which causes the audible warning to cease. Thus the operator is first warned of imminent overflow by the change in sound from continuous to intermittent, and is then warned of actual overflow by the termination of sound. Audible warning device 25 includes first orifice 27 located in top 5 of fluid holding chamber 1 and second orifice 29 located in body 31 of audible warning device 25. The interior of body 31 forms sound chamber 33. Second orifice 29 connects sound chamber 33 and body 31 with exit tube 37. As shown in FIG. 1, exit tube 37 is sized to accommodate the optional attachment thereto of extension hose 39, which maximizes the effective size of audible warning device 25 to increase the audible warning emanating therefrom and also acts as a vent line. First orifice 27 and second orifice 29 have bevelled edges. The relative size of first orifice 27 and second orifice 29, and the respective bevelled edges thereon directly affect the pitch and tone of the sound emanating from audible warning device 25.

Fluid holding chamber 1, as well as all other listed elements of the present invention, can be comprised of, for example, a synthetic polymer, or metal. The exemplary synthetic polymer, high density polyethylene, can be extruded or injection-molded, for example, to produce fluid holding chamber 1 of the present invention.

While particular embodiments of the present invention have been described in some detail herein above, changes and modifications may be made in the illustrated embodiments without departing from the spirit of the invention.

I claim:

1. A fluid spillage control apparatus adapted to be connected to a fluid tank which has a fill opening and a ventilation opening, said fluid spillage control apparatus comprising:

a fluid holding chamber having side walls and a longitudinal axis parallel with such side walls;

a vent opening in said fluid holding chamber for venting vapor therefrom; and conduit means in said fluid holding chamber communicating with a fluid tank ventilation opening for passage of excess fluid from a fluid tank into said fluid holding chamber, said conduit means having an end, said conduit means having a length that is aparellel to said side walls and to said longitudinal axis of said fluid holding chamber such that said fluid holding such that said fluid holding chamber can be oriented in both a first position where said fluid holding chamber longitudinal axis is oriented substantially vertically and a second position where said fluid holding chamber longitudinal axis is oriented substantially horizontally.

2. The fluid spillage control apparatus of claim 1 further comprising:

auditory signal means communicating with said vent opening, said auditory signal means producing a sound upon passage therethrough of vented vapor from said fluid holding chamber.

3. The fluid spillage control apparatus of claim 2 wherein the sound emanating from said auditory signal means changes from continuous to intermittent prior to entry of fluid into said fluid spillage control apparatus.

4. The fluid spillage control apparatus of claim 2 wherein the sound emanating from said auditory signal means ceases upon entry of fluid into said fluid spillage control apparatus.

5. The fluid spillage control apparatus of claim 1 further comprising:

fluid return means communicating with said fluid holding chamber so that fluid in said fluid holding chamber returns to the fluid tank.

6. The fluid spillage control apparatus of claim 5 wherein said conduit means is a pipe and said fluid return means is a slit in said conduit means.

7. The fluid spillage control apparatus of claim 5 wherein said fluid holding chamber has a floor, said floor comprised of at least a first portion and a second portion, said second portion being angled with respect to said first portion to direct fluid in said fluid chamber to said fluid return means.

8. The fluid spillage control apparatus of claim 1 further comprising:

fluid deflector means oriented adjacent said end of said conduit means to deflect fluid downwardly into said fluid holding chamber.

9. The fluid spillage control apparatus of claim 8 wherein said fluid deflector means is a plate.

10. A fluid spillage control apparatus adapted to be connected to a fluid tank which has a fill opening and a ventilation opening, said fluid spillage control apparatus comprising:

a fluid holding chamber having side walls and a longitudinal axis parallel with said side walls;

a vent opening in said fluid holding chamber for venting vapor therefrom;

conduit means in said fluid holding chamber communicating with a fluid tank ventilation opening for passage of excess fluid from a fluid tank into said fluid holding chamber, said conduit means having an end, said conduit means having a length that is aparallel to said side walls and to said longitudinal axis of said fluid holding chamber such that said fluid holding chamber can be oriented in both a first position where said fluid holding chamber longitudinal axis is oriented substantially vertically and a second position where said fluid holding chamber longitudinal axis is oriented substantially horizontally; and auditory signal means communicating with said vent opening, said auditory signal means producing a sound upon passage therethrough of vented vapor from said fluid holding chamber such that the sound changes from continuous to intermittent prior to entry of fluid into said fluid spillage control apparatus and the sond ceases upon entry of fluid into said fluid spillage control apparatus.

11. The fluid spillage control apparatus of claim 10 further comprising:

fluid return means communicating with said fluid holding chamber so that fluid in said fluid holding chamber returns to the fluid tank.

12. The fluid spillage control apparatus of claim 11 wherein said conduit means is a pipe and said fluid return means is a slit in said conduit.

13. The fluid spillage control apparatus of claim 10 wherein said fluid holding chamber has a floor, said floor comprised of at least a first portion and a second portion, said second portion being angled with respect to said first portion to direct fluid in said fluid chamber to said fluid return means.

14. The fluid spillage control apparatus of claim 10 further comprising:

fluid deflector means oriented adjacent said end of said conduit means to deflect fluid downwardly into said fluid holding chamber.

15. The fluid spillage control apparatus of claim 14 wherein said fluid deflector means is a plate.

* * * * *